US008926384B1

(12) United States Patent
Alphin

(10) Patent No.: US 8,926,384 B1
(45) Date of Patent: Jan. 6, 2015

(54) AUXILIARY OAR BLADE ASSEMBLY

(76) Inventor: Kent Alphin, Wilmington, NC (US)

( * ) Notice: Subject to any disclaimer, the term of this patent is extended or adjusted under 35 U.S.C. 154(b) by 289 days.

(21) Appl. No.: 13/536,097

(22) Filed: Jun. 28, 2012

Related U.S. Application Data

(60) Provisional application No. 61/590,485, filed on Jan. 25, 2012.

(51) Int. Cl.
*B63H 16/04* (2006.01)
*B63H 16/10* (2006.01)

(52) U.S. Cl.
USPC ..... 440/101

(58) Field of Classification Search
CPC ..... B63H 16/04
USPC ..... 440/101
See application file for complete search history.

(56) References Cited

U.S. PATENT DOCUMENTS

| | | | | |
|---|---|---|---|---|
| 1,817,414 | A | 8/1931 | Korth | |
| 2,367,222 | A | 1/1945 | Kurtz | |
| 2,590,991 | A | 4/1952 | McDonald | |
| 3,059,255 | A | 10/1962 | Franklin | |
| 4,820,216 | A | 4/1989 | Masters | |
| 6,022,255 | A | 2/2000 | Lukanovich | |
| 7,367,858 | B2 | 5/2008 | Matuska et al. | |
| 8,100,733 | B1 * | 1/2012 | Ross et al. | 440/101 |

FOREIGN PATENT DOCUMENTS

| | | |
|---|---|---|
| WO | WO2010122415 | 10/2010 |

* cited by examiner

*Primary Examiner* — Daniel V Venne

(57) ABSTRACT

An auxiliary oar blade assembly is provided for attachment to a shaft of an existing oar opposite an existing blade to provide a two bladed oar. The assembly includes a blade and an elongated connector coupled to and extending from the blade. A channel extends through the connector. The channel is configured for receiving a shaft of an oar therein. A coupler is coupled to the connector securing the connector to the shaft of the oar.

16 Claims, 6 Drawing Sheets

AUXILIARY OAR BLADE ASSEMBLY

CROSS-REFERENCE TO RELATED APPLICATIONS

This application claims benefit of the U.S. Provisional Application No. 61/590,485 filed on Jan. 25, 2012.

BACKGROUND OF THE DISCLOSURE

Field of the Disclosure

The disclosure relates to oar blade devices and more particularly pertains to a new oar blade device for attaching to a shaft of an existing oar opposite an existing blade to provide a two bladed oar.

SUMMARY OF THE DISCLOSURE

An embodiment of the disclosure meets the needs presented above by generally comprising a blade and an elongated connector coupled to and extending from the blade. A channel extends through the connector. The channel is configured for receiving a shaft of an oar therein. A coupler is coupled to the connector securing the connector to the shaft of the oar.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF THE DRAWINGS

The disclosure will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
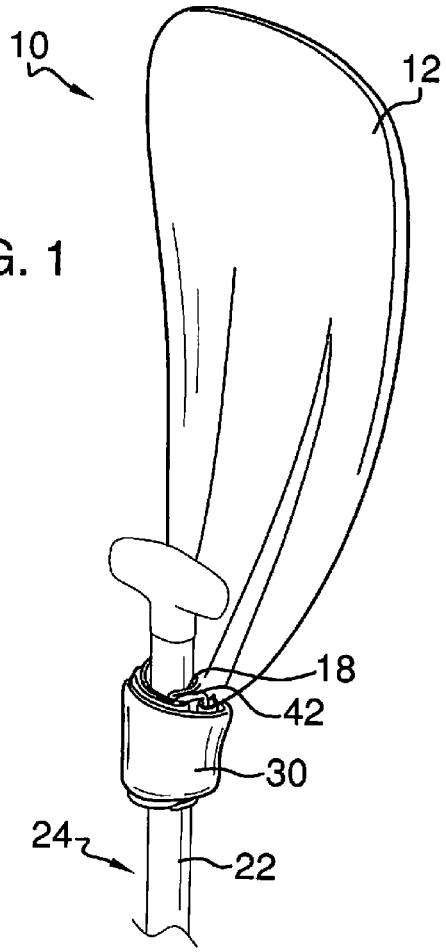
FIG. 1 is a top front side perspective view of a auxiliary oar blade assembly according to an embodiment of the disclosure.
Figure 2:
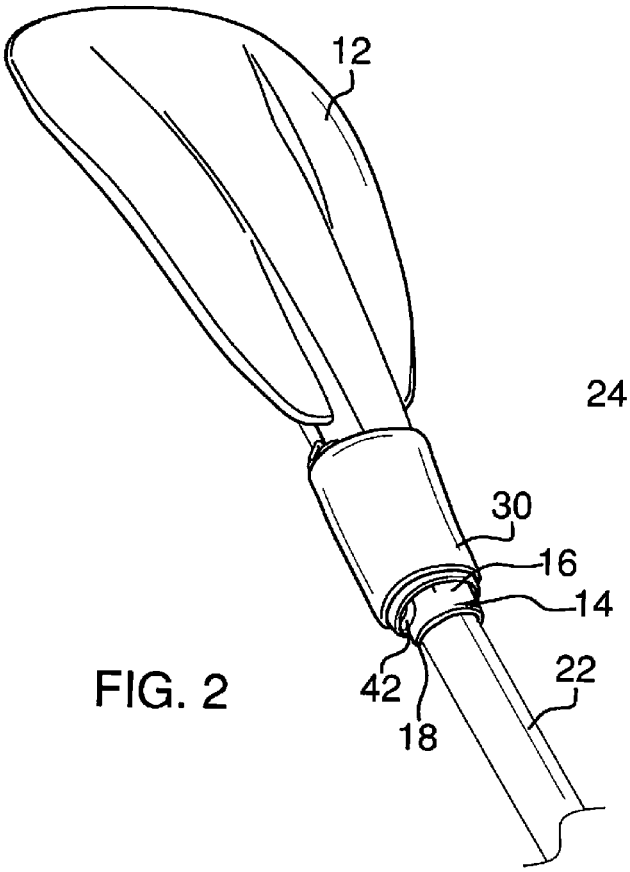
FIG. 2 is a bottom rear side perspective view of an embodiment of the disclosure.
Figure 3:
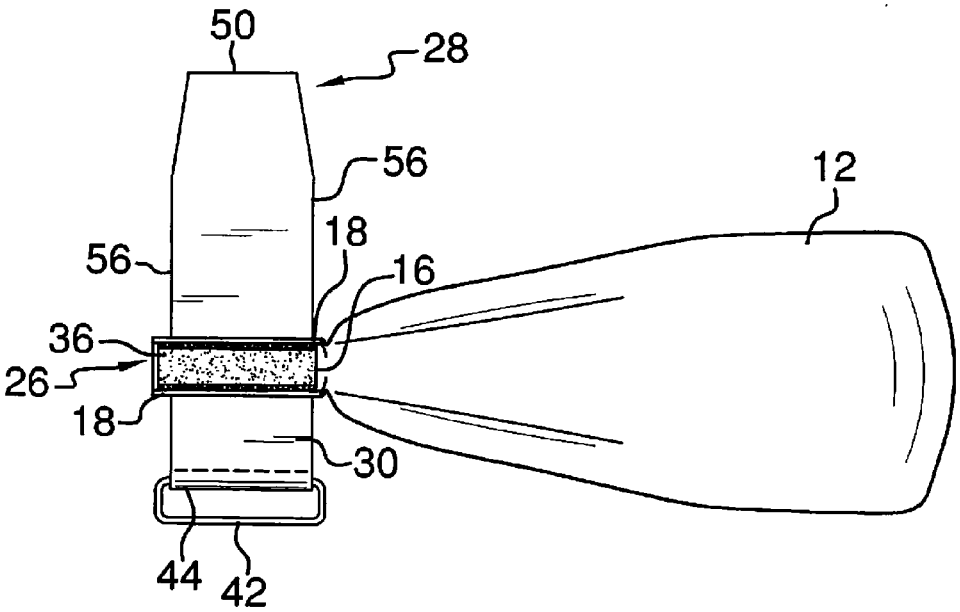
FIG. 3 is a front view of an embodiment of the disclosure.
Figure 4:
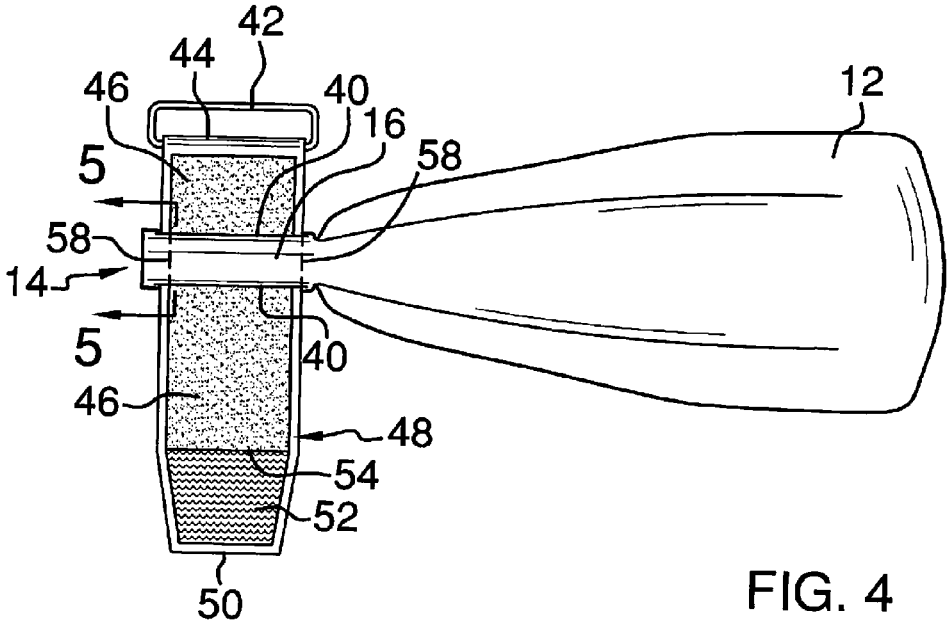
FIG. 4 is a rear view of an embodiment of the disclosure.
Figure 5:
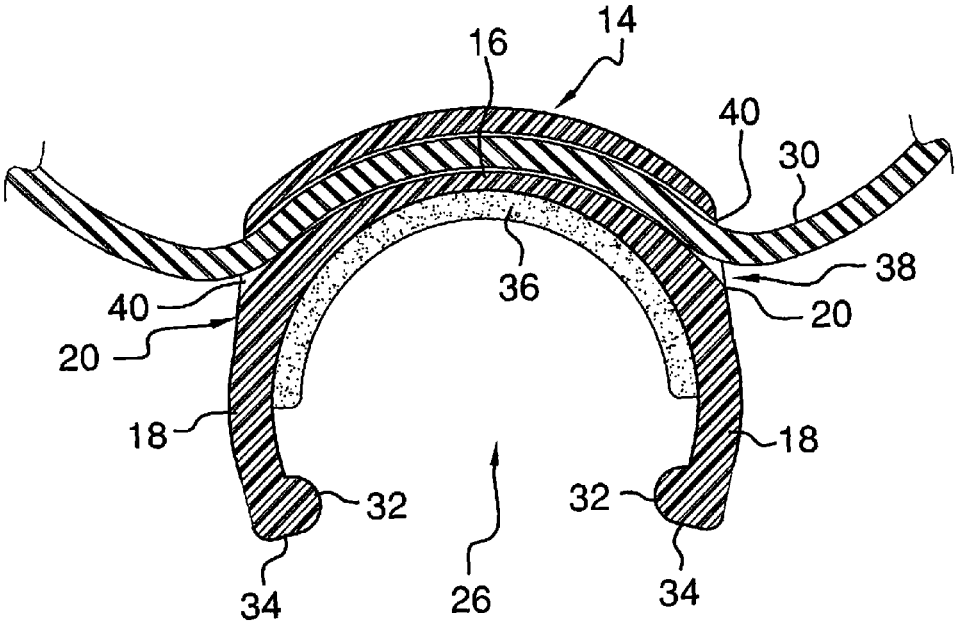
FIG. 5 is a cross-sectional view of an embodiment of the disclosure taken along line 5-5 of FIG. 4.

With reference now to the drawings, and in particular to FIGS. 1 through 9 thereof, a new oar blade device embodying the principles and concepts of an embodiment of the disclosure and generally designated by the reference numeral 10 will be described.

As best illustrated in FIGS. 1 through 9, the auxiliary oar blade assembly 10 generally comprises a blade 12 and an elongated connector 14 coupled to and extending from the blade 12. The connector 14 has a generally rectangular main section 16 and a pair of resilient arms 18 coupled to and extending from opposite longitudinal sides 20 of the main section 16 of the connector 14. This structure forms a channel 26 extending through the connector 14. The channel 26 is configured for receiving a shaft 22 of an oar 24. The channel 26 may be coextensive with the connector 14. The arms 18 may be arcuate extending outwardly from the opposite sides 20 of the main section 16 of the connector 14 such that the arms 18 envelope and grip the shaft 22 of the oar 24 when the shaft 22 is inserted into the channel 26. A coupler 28 is coupled to the connector 14 securing the connector 14 to the shaft 22 of the oar 24. A pair of bulbous projections 32 may be provided. Each projection 32 extends inwardly into the channel 26 and may further extend a full length along a free edge 34 of each of the arms 18. A pad 36 may be coupled to the connector 14 extending through the channel 26. The pad 36 may be constructed of a foam material providing frictional engagement with the shaft 22 to inhibit twisting of the blade 12 relative to the shaft 22 during use.

The coupler 28 may be a strap 30 as shown in FIGS. 1 through 5. A conduit 38 extends through the connector 14. The conduit 38 has open ends 40 with each open end 40 being positioned adjacent to an associated one of the arms 18. The strap 30 extends through the conduit 38. The conduit 38 may be coextensive with the main section 16 of the connector 14. A loop 42 is coupled to a first end 44 of the strap 30. A first portion of hook and loop fastener 46 is coupled to the strap 30 on a first face 48 of the strap 30 proximate a second end 50 of the strap 30. A second portion of hook and loop fastener 52 is coupled to the strap 30 and is complimentary to the first portion of hook and loop fastener 46. Thus, the strap 30 is securable around the arms 18 by inserting the second end 50 of the strap 30 through the loop 42 and engaging the first portion of hook and loop fastener 46 to the second portion of hook and loop fastener 52. The second portion of hook and loop fastener 52 may be positioned on the first face 48 of the strap 30 to allow folding the strap 30 over the loop 42 to engage the first portion of hook and loop fastener 46 to the second portion of hook and loop fastener 52. The second portion of hook and loop fastener 52 may be positioned proximate the loop 42 and extend towards the first portion of hook and loop fastener 46. An edge 54 of the second portion of hook and loop fastener 52 may abut the first portion of hook and loop fastener 46. Thus, the strap 30 may be wrapped tightly around the arms 18 for secure attachment. A pair of longitudinal edges 56 of the strap 30 may abut opposite sides 58 of the conduit 38 whereby a width of the strap 30 is coextensive with a width of the conduit 38. The width of the strap 30 may be between 8 and 12 centimeters.

Figure 6:
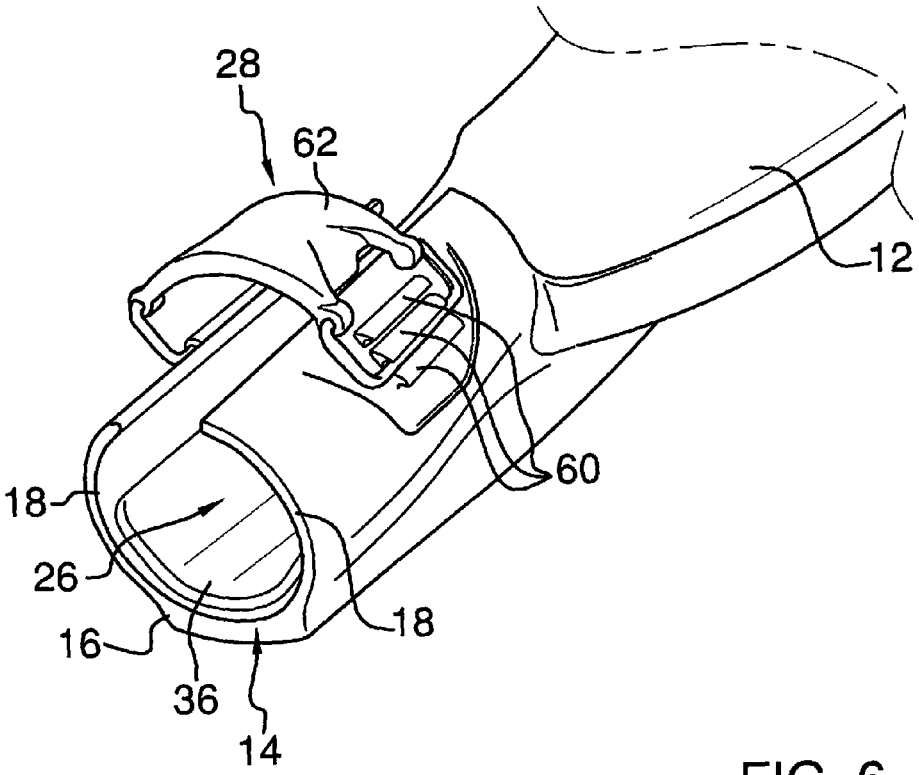
FIG. 6 is a bottom front side perspective view of an alternate embodiment of the disclosure.

As shown in FIG. 6, at least one hook 60 may be coupled to and extend from the connector 14. In this embodiment, the coupler 28 is a clasp 62 selectively engageable to the hook 60 whereby the connector 14 is secured to the shaft 22 of the oar 24. Multiple spaced hooks 60 may be provided to provide secure attachment to a range of diameters of the shaft 22.

Figure 7:
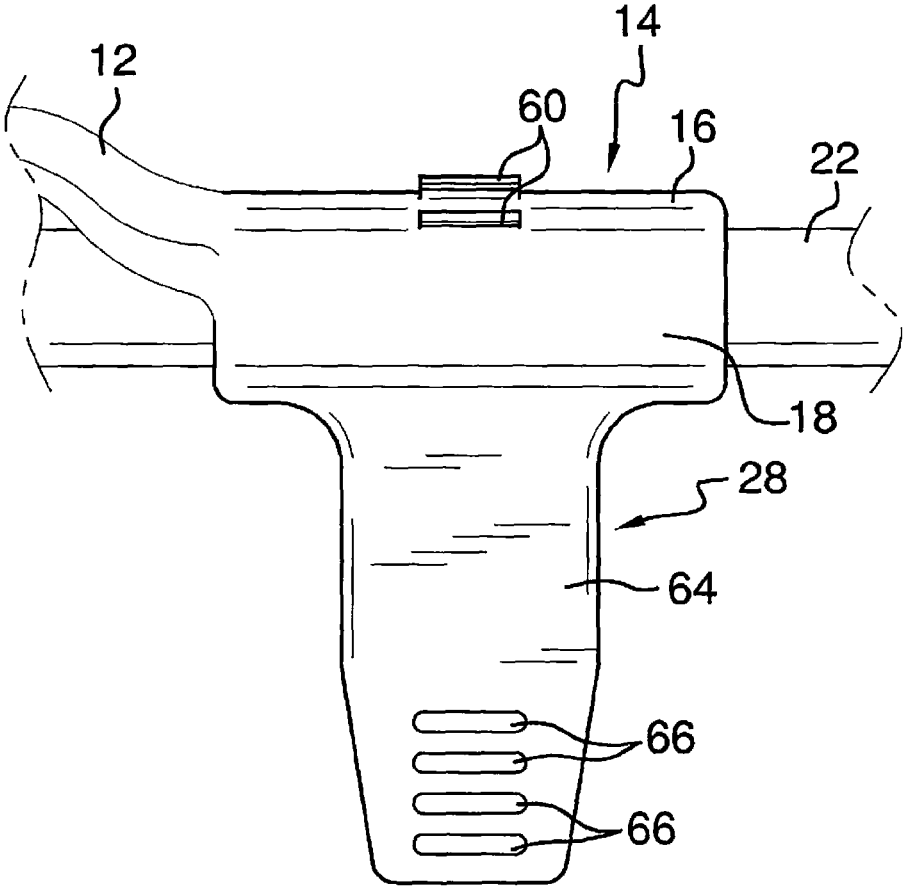
FIG. 7 is a side view of an alternate embodiment of the disclosure.

As shown in FIG. 7, at least one hook 60 again may be coupled to and extend from the connector 14. The coupler 28 may be a strap 64 integrally coupled or otherwise secured to and extending from the connector 14. The strap 64 has a plurality of slots 66. Each slot 66 is selectively engageable to the hook 60 whereby the connector 14 is secured to the shaft 22 of the oar 24. Again multiple hooks 60 may be employed with multiple slots 66 each engaging an associated hook 60.

Figure 8:
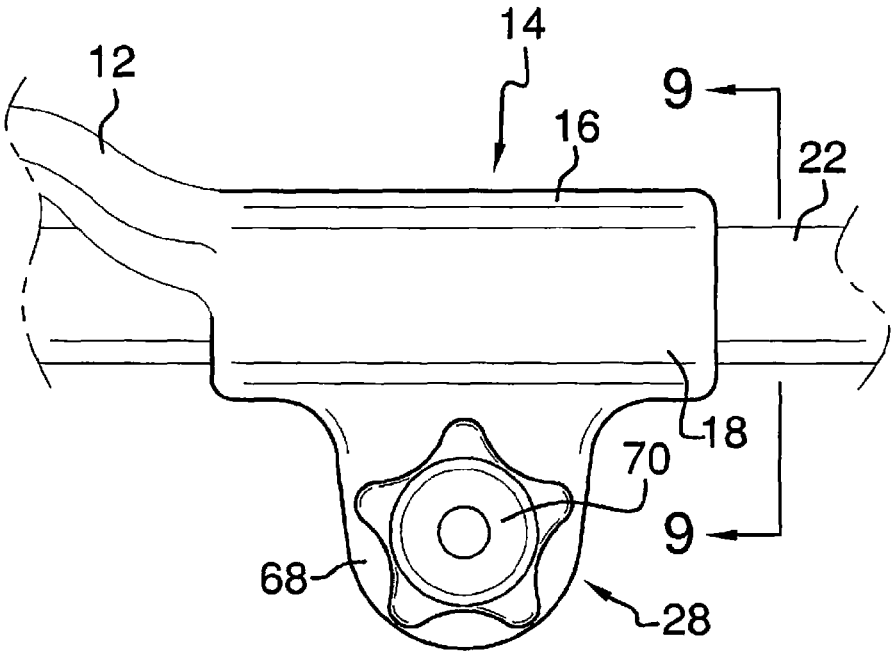
FIG. 8 is a side view of an alternate embodiment of the disclosure.
Figure 9:
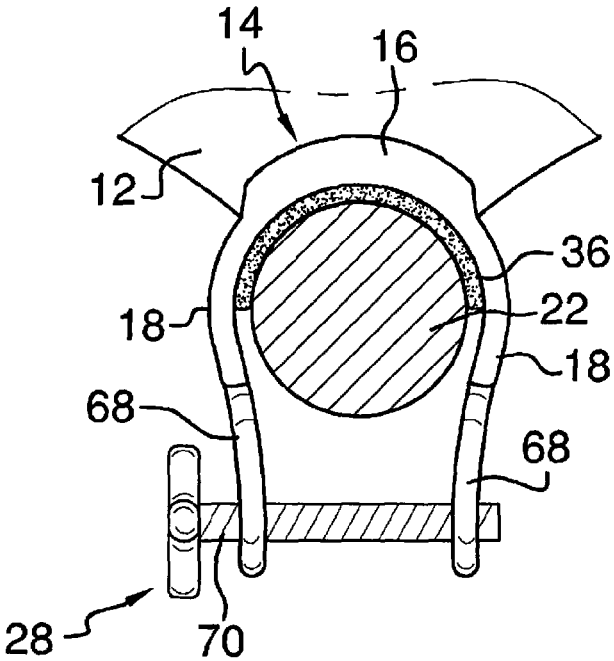
FIG. 9 is a cross-sectional view of an embodiment of the disclosure taken along line 9-9 of FIG. 8.

In another embodiment, as shown in FIGS. 8 and 9, a pair of flanges 68 is coupled to and extends from the connector 14. The coupler 28 is a screw 70 coupled to the flanges 68 whereby the connector 14 is secured to the shaft 22 of the oar 24 when the screw 70 is tightened.

The blade 12 has a length between 30 centimeters and 52 centimeters. The blade 12 has a width between 12 centimeters and 24 centimeters. A diameter of the channel 26 is between 7.5 centimeters and 11 centimeters at rest. The diameter of the channel 26 will resiliently adjust to the diameter of the shaft 22 of the oar 24. The connector 14 has a length between 7.5 centimeters and 15 centimeters and a width between 5 centimeters and 7.5 centimeters.

In use, the assembly 10 may be stored or kept apart from the oar 24 until needed or desired. When desired, such as to reduce energy expended while paddling, the blade 12 is attached to the oar 24 by inserting the shaft 22 of the oar 24 into the channel 26 and securing the connector 14 using the desired coupler 28. The oar 24 may then be used just as a conventional two bladed oar is used. The blade 12 may be removed when desired.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure.

I claim:

1. An auxiliary oar blade assembly comprising:

a blade;

an elongated connector coupled to and extending from said blade, a channel extending through said connector, said channel being configured for receiving a shaft of an oar therein;

a coupler coupled to said connector, said coupler securing said connector to the shaft of the oar;

a conduit extending through said connector, said conduit having open ends, each open end being positioned adjacent to an associated one of said arms; and said coupler being a strap, said strap extending through said conduit.

2. The assembly of claim 1, further including a pad coupled to and extending through said channel.

3. The assembly of claim 1 further including said channel being coextensive with said connector.

4. The assembly of claim 1, further comprising:

a loop coupled to a first end of said strap;

a first portion of hook and loop fastener coupled to said strap;

a second portion of hook and loop fastener coupled to said strap, said first portion of hook and loop fastener being complimentary to said second portion of hook and loop fastener whereby said strap is securable around said arms by inserting said second end of said strap through said loop and engaging said first portion of hook and loop fastener to said second portion of hook and loop fastener.

5. The assembly of claim 4, further comprising:

said first portion of hook and loop fastener being positioned on a first face of said strap proximate a second end of said strap; and said second portion of hook and loop fastener being positioned on said first face of said strap.

6. The assembly of claim 5, further including said second portion of hook and loop fastener being positioned proximate said loop and extending towards said first portion of hook and loop fastener.

7. The assembly of claim 6, further including an edge of said second portion of hook and loop fastener abutting said first portion of hook and loop fastener.

8. The assembly of claim 1, further including said conduit being coextensive with said main section of said connector.

9. The assembly of claim 8, further including longitudinal edges of said strap abutting opposite sides of said conduit whereby a width of said strap is coextensive with a width of said conduit.

10. The auxiliary oar blade assembly of claim 1, further comprising:

said connector having a rectangular main section and a pair of resilient arms coupled to and extending from opposite longitudinal sides of said main section of said connector, said arms being arcuate extending outwardly from said opposite sides of said main section of said connector, said channel being coextensive with said connector;

a pad coupled to and extending through said channel;

said conduit being coextensive with said main section of said connector;

a loop coupled to a first end of said strap;

a first portion of hook and loop fastener coupled to said strap, said first portion of hook and loop fastener being positioned on a first face of said strap proximate a second end of said strap;

a second portion of hook and loop fastener coupled to said strap, said first portion of hook and loop fastener being complimentary to said second portion of hook and loop fastener whereby said strap is securable around said arms by inserting said second end of said strap through said loop and engaging said first portion of hook and loop fastener to said second portion of hook and loop fastener, said second portion of hook and loop fastener being positioned on said first face of said strap, said second portion of hook and loop fastener being positioned proximate said loop and extending towards said first portion of hook and loop fastener;

an edge of said second portion of hook and loop fastener abutting said first portion of hook and loop fastener; and a pair of longitudinal edges of said strap abutting opposite sides of said conduit whereby a width of said strap is coextensive with a width of said conduit.

11. An auxiliary oar blade assembly comprising:

a blade;

an elongated connector coupled to and extending from said blade, a channel extending through said connector, said channel being configured for receiving a shaft of an oar therein;

a coupler coupled to said connector, said coupler securing said connector to the shaft of the oar; and said connector having a rectangular main section and a pair of resilient arms coupled to and extending from opposite longitudinal sides of said main section of said connector.

12. The assembly of claim 11, further including said arms being arcuate extending outwardly from said opposite sides of said main section of said connector.

13. The assembly of claim 11, further including a bulbous projection extending inwardly into said channel and extending along a free edge of each of said arms.

14. An auxiliary oar blade assembly comprising:

a blade:

an elongated connector coupled to and extending from said blade, a channel extending through said connector, said channel being configured for receiving a shaft of an oar therein;

a coupler coupled to said connector, said coupler securing said connector to the shaft of the oar;

at least one hook coupled to and extending from said connector; and said coupler being a clasp, said clasp being selectively engageable to said hook whereby said connector is secured to the shaft of the oar.

15. An auxiliary oar blade assembly comprising:

a blade:

an elongated connector coupled to and extending from said blade, a channel extending through said connector, said channel being configured for receiving a shaft of an oar therein;

a coupler coupled to said connector, said coupler securing said connector to the shaft of the oar;

at least one hook coupled to and extending from said connector; and said coupler being a strap having a plurality of slots, each slot being selectively engageable to said hook whereby said connector is secured to the shaft of the oar.

16. An auxiliary oar blade assembly comprising:

a blade:

an elongated connector coupled to and extending from said blade, a channel extending through said connector, said channel being configured for receiving a shaft of an oar therein;

a coupler coupled to said connector, said coupler securing said connector to the shaft of the oar;

a pair of flanges coupled to and extending from said connector; and said coupler being a screw coupled to said flanges whereby said connector is secured to the shaft of the oar when said screw is tightened.

* * * * *